US007322110B2

(12) United States Patent
Hernandez et al.

(10) Patent No.: US 7,322,110 B2
(45) Date of Patent: Jan. 29, 2008

(54) KNIFE WITH TRIGGER ACTUATOR FOR RETRACTABLE BLADE

(75) Inventors: Hector Ray Hernandez, Fullerton, CA (US); Jaime Nash, Rancho Santa Margarita, CA (US); Han Chung Tseng, Nantou (TW)

(73) Assignee: Alltrade Tools LLC, Long Beach, CA (US)

( * ) Notice: Subject to any disclaimer, the term of this patent is extended or adjusted under 35 U.S.C. 154(b) by 0 days.

(21) Appl. No.: 11/511,076

(22) Filed: Aug. 28, 2006

(65) Prior Publication Data

US 2007/0074402 A1 Apr. 5, 2007

Related U.S. Application Data

(63) Continuation of application No. 10/488,914, filed as application No. PCT/US03/16121 on May 22, 2003, now abandoned.

(51) Int. Cl.
*B26B 1/08* (2006.01)

(52) U.S. Cl. ..... 30/162; 30/335

(58) Field of Classification Search ..... 30/162, 30/335, 2, 151, 329

See application file for complete search history.

(56) References Cited

U.S. PATENT DOCUMENTS

| | | | | |
|---|---|---|---|---|
| 2,198,111 | A | 4/1940 | Gorbatenko et al. | |
| 2,552,945 | A | 5/1951 | Eaton et al. | |
| 3,577,637 | A | 5/1971 | Braginetz | |
| 4,139,939 | A | 2/1979 | Crooks | |
| 4,683,656 | A | 8/1987 | Peyrot et al. | |
| 4,713,885 | A | 12/1987 | Keklak et al. | |
| 4,757,612 | A | 7/1988 | Peyrot | |
| 4,930,218 | A | 6/1990 | Jacoff | |
| 5,031,322 | A | 7/1991 | Jacoff | |
| 5,086,562 | A | 2/1992 | Jacoff | |
| 5,303,474 | A | 4/1994 | Keklak et al. | |
| 5,426,855 | A | 6/1995 | Keklak et al. | |
| 5,581,890 | A | 12/1996 | Schmidt | |
| 5,890,294 | A * | 4/1999 | Keklak et al. | 30/125 |
| 5,924,203 | A * | 7/1999 | Huang | 30/142 |
| 6,000,136 | A | 12/1999 | Owens | |
| 6,192,589 | B1 | 2/2001 | Martone et al. | |
| D462,250 | S | 9/2002 | Ping | |
| 6,813,833 | B2 * | 11/2004 | Saunders et al. | 30/162 |
| 6,829,827 | B2 | 12/2004 | Tseng | |
| 2002/0124418 | A1 | 9/2002 | Votolato | |

FOREIGN PATENT DOCUMENTS

DE 202 10 670 U1 * 10/2002

* cited by examiner

*Primary Examiner*—Hwei-Siu C. Payer
(74) *Attorney, Agent, or Firm*—Fulwider Patton LLP

(57) ABSTRACT

A knife has a blade that can be contained within a housing when not in use and extended outside the housing when used. Additional blades can be stored within the housing, and when desired, loaded onto a blade seat. A trigger actuator moves a blade seat carrying a blade between extended and retracted positions. The blade seat may be locked into a number of different positions.

5 Claims, 12 Drawing Sheets

KNIFE WITH TRIGGER ACTUATOR FOR RETRACTABLE BLADE

CROSS-REFERENCES TO RELATED APPLICATIONS

This application is a continuation application of U.S. application Ser. No. 10/488,914, entitled "KNIFE WITH TRIGGER ACTUATOR FOR RETRACTABLE BLADE," filed on Mar. 4, 2004 now abandoned, pursuant to 35 USC 371, claiming priority of International Application No. PCT/US03/16121, filed May 22, 2003. These related applications are incorporated herein by reference and made a part of this application.

DEFINITIONS

The words "comprising," "having," and "including," and other forms thereof, are intended to be equivalent in meaning and be open ended in that an item or items following any one of these words is not meant to be an exhaustive listing of such item or items, or meant to be limited to only the listed item or items.

BACKGROUND OF THE INVENTION

Text Hand held knives such as box cutters or utility knives are in wide spread use. Typically, a utility knife has a blade that may be extended when in use, and retracted when not in use. A user extends and retracts the blade by using his or her thumb to manually push the blade back and forth. U.S. Pat. No. 4,930,218 is illustrative of a conventional utility knife.

SUMMARY OF THE INVENTION

This invention has one or more features as discussed subsequently herein. After reading the following section entitled "DETAILED DESCRIPTION OF SOME EMBODIMENTS OF THIS INVENTION," one will understand how the features of this invention provide its benefits. The benefits of this invention include, but are not limited to: control of extension and retraction of the knife's blade by means of a convenient to use trigger mechanism, an ergonomic design of a handle for the knife facilitating actuation of the trigger mechanism, a locking mechanism for locking the blade in a selected position, and convenient replacement of blades from a stack of blades retained in a storage station.

Without limiting the scope of this invention as expressed by the claims that follow, some, but not necessarily all, of its features are:

One, means are provided for housing a blade. Typically, a housing having a handle portion is employed.

Two, means are provided for carrying a blade mounted thereon. For example, a blade seat adapted to carry a blade detachably mounted thereon is at least partially positioned in the housing. This blade seat is movable between a retracted position where a blade mounted thereon is within the housing and an extended position where at least a portion of the blade mounted thereon extends from the housing. At least one rail element may be within the housing that guides the movement of the blade seat. The blade in the retracted position typically is wholly within the housing. The blade seat may have multitude of positions where a blade attached thereto extends from the housing. For example, one of the positions is where at least a third of a blade attached thereto lies external to the housing. Alternately, it may have a first extended position where no more than about a quarter of a blade mounted thereon projects outward from the housing, and a second extended position where at least about ⅜ of the length of the blade projects outward from the housing. Typically, at least about a sixth of a blade attached thereto lies external to the housing with the blade seat in the extended position. The knife may include a blade release mechanism that enables the blade to be manually removed from the blade seat when the blade seat is in the extended position.

Three, means are provided for actuating the blade seat to move it between the retracted and extended positions. A trigger actuator accomplishes this function. It may be attached to the housing nearby the handle portion and may be mounted thereto to move from a first position to a second position. The trigger actuator may be mounted inward towards the handle portion, for example, it may be pivoted at one end and actuated by squeezing it. Alternately, the trigger actuator may be mounted to the housing to slide and actuated by sliding it sideways.

Four, means are provided for connecting together the actuating means and the blade carrying means. Typically, a linkage assemblage at least partially within the housing connected between the trigger actuator and the blade seat moves the blade seat. Upon squeezing the trigger actuator, the blade seat is moved into the extended position as the trigger actuator moves from the first position to second position. With the release of the trigger actuator, the blade seat moves into the retracted position as the trigger actuator moves from the second position to first position. The linkage assemblage may comprise a plurality of arms attached to each other to pivot, with one arm attached to the blade seat and another arm attached to the trigger actuator. The arms may be in a folded condition when the trigger actuator is in the first position and in an unfolded condition when the trigger actuator is in the second position. The linkage assemblage may include a cam that has an edge portion that engages the blade seat to move the blade seat from a retracted position to an extended position. A spring may be used to return the blade seat to the retracted position.

Five, the knife may use a locking element. One type of locking element keeps the blade seat in the extended position until unlocked. Another type of locking element keeps the blade seat in the retracted position until unlocked and keeps the blade seat in the extended position until unlocked. A release member that is manually actuated may be used to unlock the locking element. Alternately, no locking element need be used. In such an embodiment, the trigger actuator is manually depressed to move from the first position to the second position and the blade seat is maintained in the extended position as long as the trigger actuator is manually squeezed or gripped. The blade seat is biased to return to the retracted position upon release of the manual grip of the trigger actuator. For example, an elastic return mechanism such as a spring may be used which automatically returns the blade seat to the retracted position.

Six, a manually actuated release member having a button element may be employed. Such a button element may project outward from the housing. In one embodiment, the button element is located in a side of the housing to enable a thumb of a user's hand while gripping the handle portion to depress the button element. A finger element may project from the button element into the housing and engage the blade seat when the button element is not depressed and disengage from the blade seat when the button element is depressed. For example, the blade seat may include one or more slots and the finger element is disposed in a selected one of these slots when the finger element engages the blade seat. In one embodiment, the housing may have on an exterior surface a guide member that directs the user's thumb to the release member. Such a guide member may comprise a groove in the side of the housing.

These features are not listed in any rank order nor is this list intended to be exhaustive.

BRIEF DESCRIPTION OF THE DRAWINGS

Text Some embodiments of this invention, illustrating all its features, will now be discussed in detail. These embodiments depict the novel and non-obvious knife of this invention as shown in the accompanying drawing, which is for illustrative purposes only. This drawing includes the following figures (FIGS.), with like numerals indicating like parts.

DETAILED DESCRIPTION OF THE PREFERRED EMBODIMENTS

Figure 1:
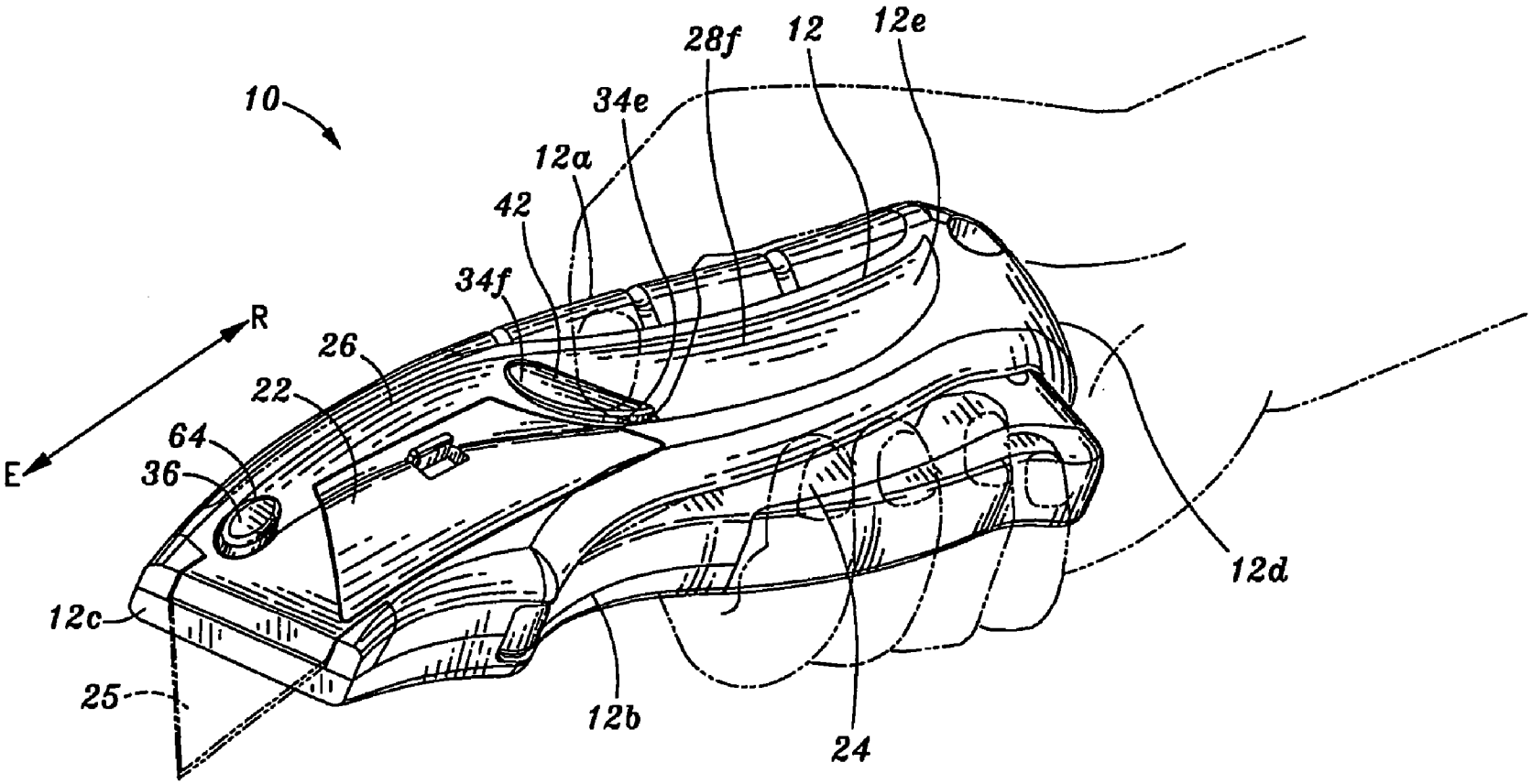
FIG. 1 is a perspective view of the knife according to one embodiment of this invention.
Figure 3:
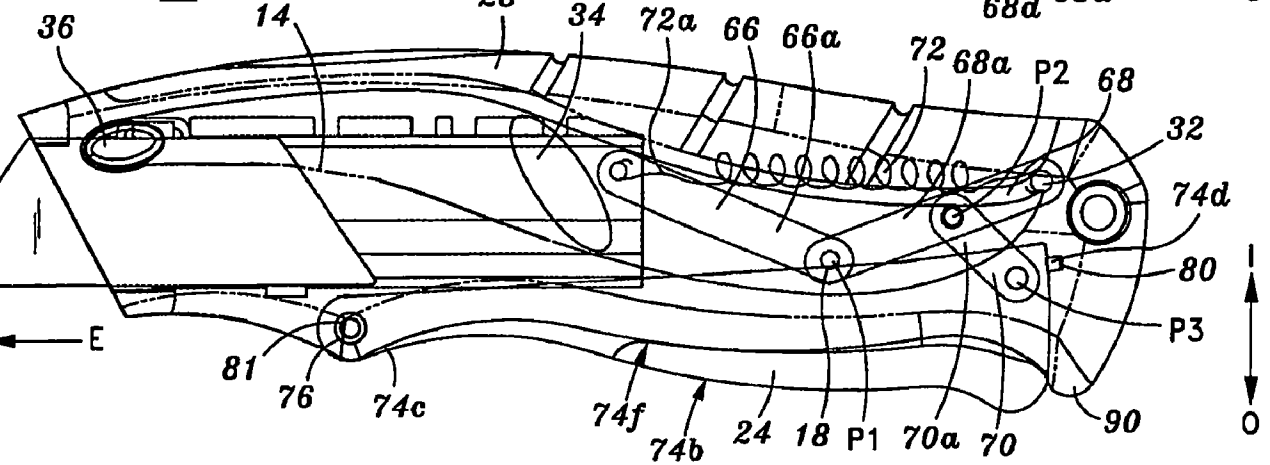
FIG. 3 is a side view of the knife similar to that shown in FIG. 2 with the blade seat in an extended position and some components shown in phantom lines.
Figure 4:
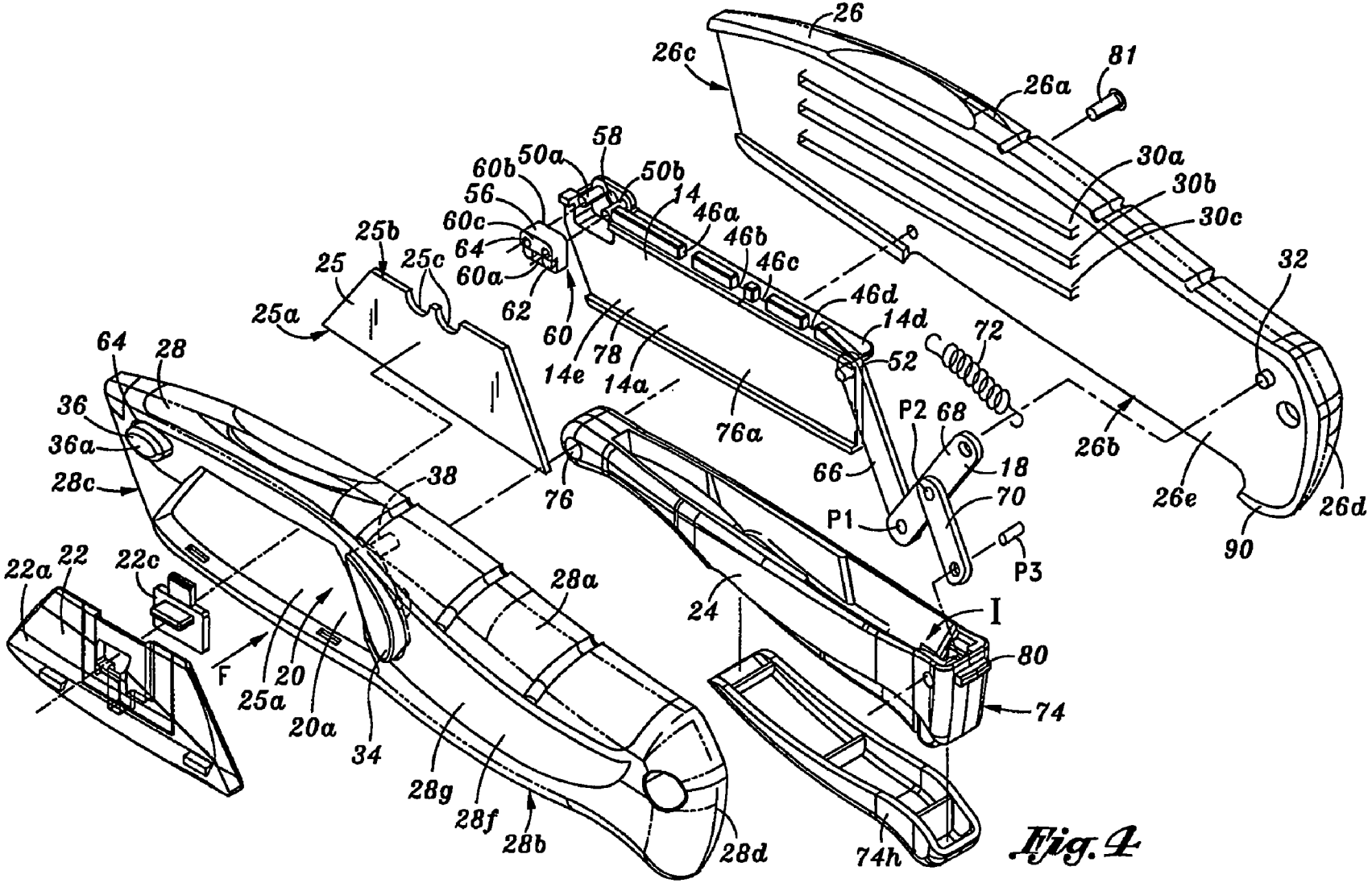
FIG. 4 is an exploded perspective view of the knife shown in FIG. 1.

Text As illustrated in FIGS. 1 and 4, one embodiment of this invention, the knife 10, comprises a housing 12, a blade seat 14 (FIG. 3), an elongated trigger actuator 24, and a linkage assemblage 18 (FIG. 2) connecting the trigger actuator and the blade seat. A novel feature of this invention is the trigger actuator 24 that is pivoted at either end to the housing. The trigger actuator 24 is manually squeezed by a user to advance the blade seat 14 in the direction indicated by the arrow E (FIG. 3). As shown in phantom lines in FIG. 1, with one hand the user grasps a rear portion 12*d* of the housing 12 that serves as a handle 12*e*. The user places his or her thumb along a side of the housing 12, with the user's fingers wrapped around the length of the trigger actuator 24. The user applies pressure with his or her fingers against the trigger actuator 24 to move it inward, advancing the blade seat 14. When the user lets go of the trigger actuator 24 by removing his or her fingers from this trigger actuator, the blade seat 14 moves in the direction indicated by the arrow R (FIG. 2) and is retracted. The blade seat 14 may be locked into either the extended or the retracted position.

The housing 12 may include a blade storage station 20 holding a stack (not shown) of blades and a removable trapezoidal shaped cover 22 (FIG. 4) for the blade storage station. The blade seat 14 is moved upon manual actuation of the trigger actuator 24 to advance a blade 25 mounted on the blade seat 14 to extend outward from the housing 12. The linkage assemblage 18 returns the blade seat 14 and blade 25 mounted thereon to the retracted position shown in FIG. 2. The blade 25 may comprise a trapezoidal shaped piece of metal having a bladed edge 25*a* (FIG. 4) longer than a non-bladed edge 25*b*. A pair of adjacent notches 25*c* (FIG. 4) may be located on the non-bladed edge 25*b*.

Figure 6:
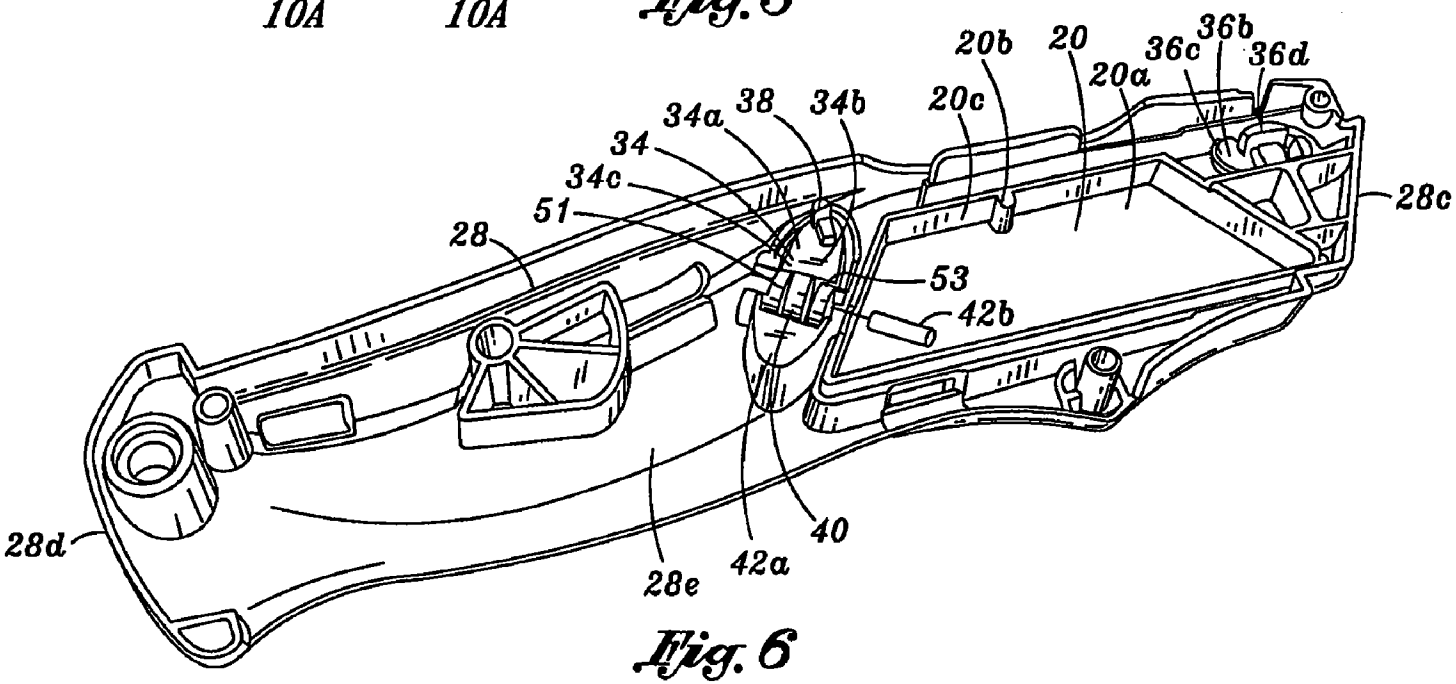
FIG. 6 is a perspective view of the left portion of the housing of the knife shown in FIG. 1.

Referring to FIGS. 1, 4 and 6, the housing 12 may comprise a right portion 26 and a left portion 28, each having a top side 26*a*, 28*a*, respectively, an underside 26*b*, 28*b*, respectively, a front end 26*c*, 28*c*, respectively, and a rear end 26*d*, 28*d*, respectively. When the right portion 26 and left portion 28 are coupled together with a conventional screw (not shown), the housing 12 is formed. This housing 12 includes a top wall 12*a*, an underside 12*b*, a front portion 12*c* and the rear portion 12*d*. Usually about half of the rear portion 12*d* of the housing 12 serves as a handle 12*e*. A part of the top sides 26*a* and 28*a* that form the top wall 12*a* of the handle 12*e* may be formed from a substantially non-slippery material such as rubber.

As best depicted in FIG. 4, the right portion 26 may have an inner side 26*e* having a set of parallel, spaced apart rails 30*a*, 30*b*, and 30*c*, and an anchor 32. The set of rails 30*a*, 30*b*, and 30*c* may be of substantially equal length, height and width, extending outward perpendicularly from the inner side 26*e*. The anchor 32 may be a cylindrical post extending from the inner side 26*e* of the right portion 26, nearby the top side 26*a* and between the set of rails 30*a*, 30*b*, and 30*c* and the rear end 26*d* of the right portion 26. As best depicted in FIG. 6, the left portion 28 of the housing 12 has an inner side 28*e*, an outer side 28*f* (FIG. 4), a locking mechanism 34, and a blade release mechanism 36.

Figure 7:
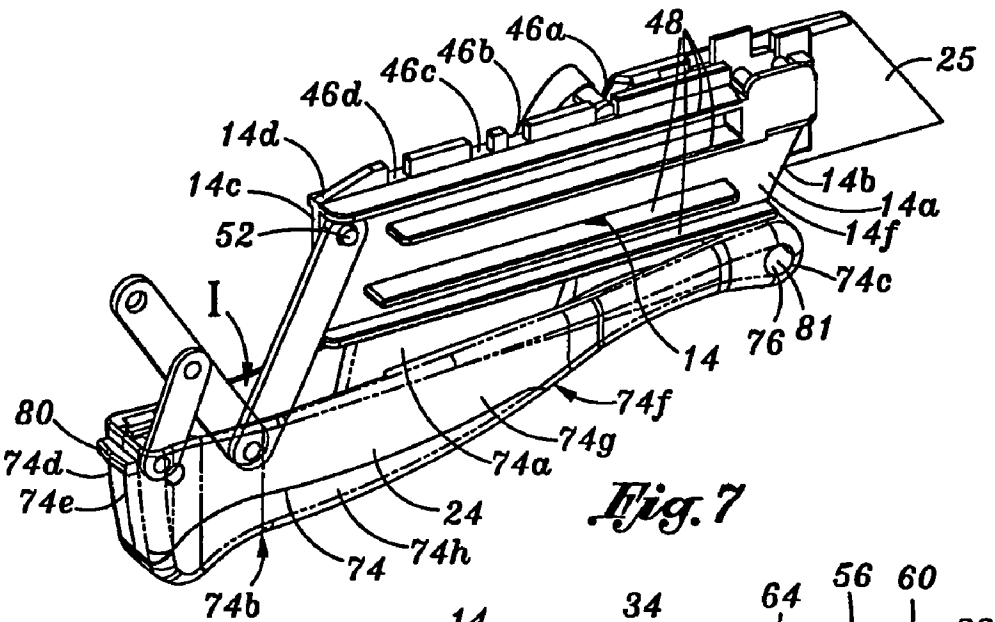
FIG. 7 is a perspective view of the knife shown in FIG. 1 partially assembled including a trigger actuator, linkage assemblage, and blade seat.

Referring to FIGS. 4 and 7, the blade seat 14 may comprise a rigid plate 14*a* having a front end 14*b*, a rear end 14*c*, a top edge 14*d*, a blade side 14*e* (FIG. 4), and a rail side

14*f* (FIG. 7). There is a cylindrically shaped anchor 52 near the rear end 14*c* projecting from the rail side 14*f* and a recessed portion 58 (FIG. 4) near the front end 14*b* having a pair of a cylindrically shaped toes 50*a*, 50*b* (FIG. 4) projecting outward from the blade side 14*e*. The blade seat 14 includes a set of parallel rails 48 on the rail side 14*f* and a series of slots 46*a*, 46*b*, 46*c*, 46*d* along the top edge 14*d*. A blade retainer 56 is mounted on the recessed portion 58 of the blade seat 14 to move reciprocally. The individual rails of the set of rails 48 project outward perpendicularly from the rail side 14*f* of the blade seat 14 and extend from nearby the rear end 14*c* to the front end 14*b* of the plate 14*a*. The set of rails 48 rest on the rails 30*a*, 30*b*, and 30*c* and slide along these rail on the right portion 26, allowing the blade seat 14 to slide within the housing 12, being guided by these rails upon actuation of the trigger actuator 24.

Figure 4A:
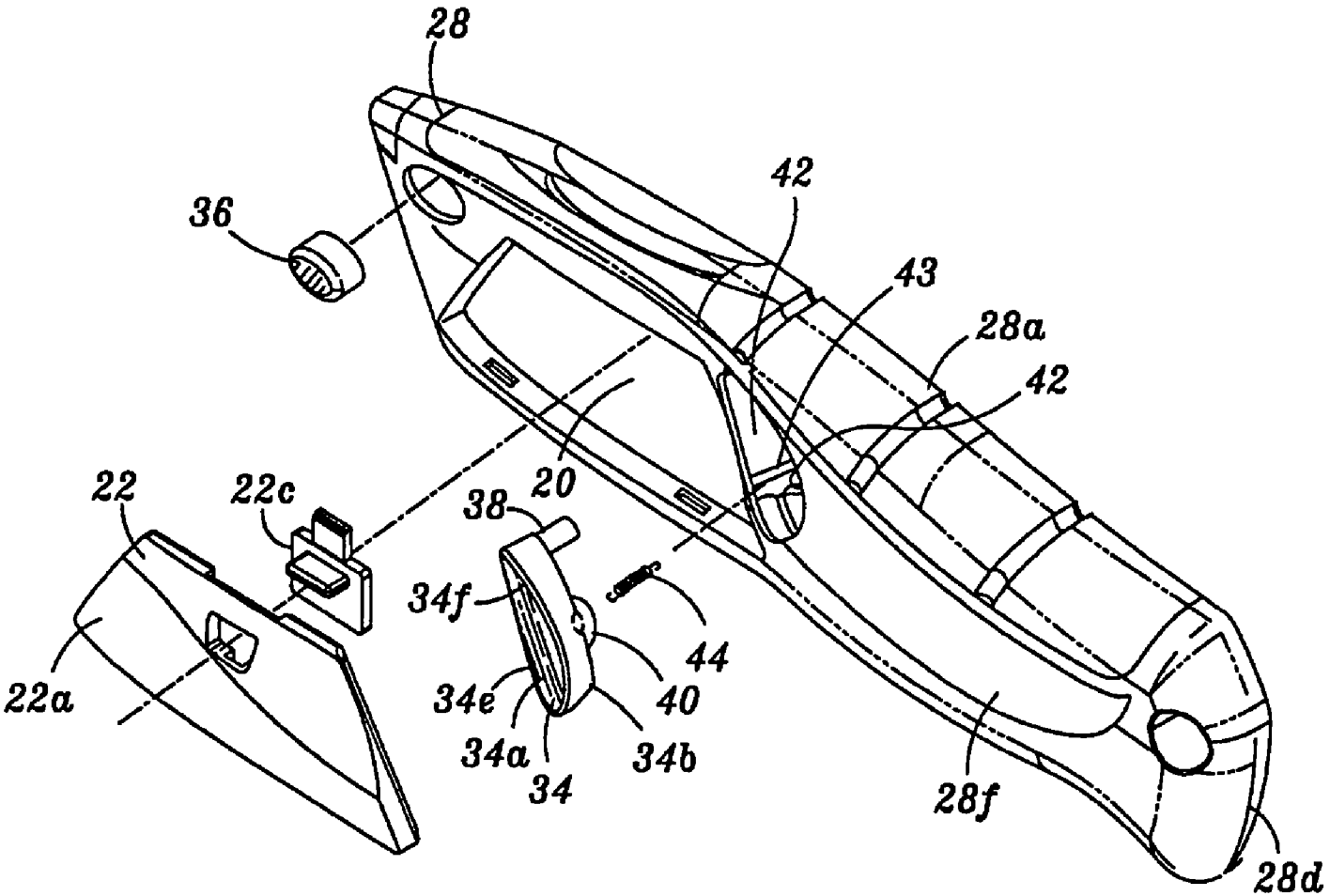
FIG. 4A is a partially assembled perspective view of the knife shown in FIG. 4.
Figure 5:
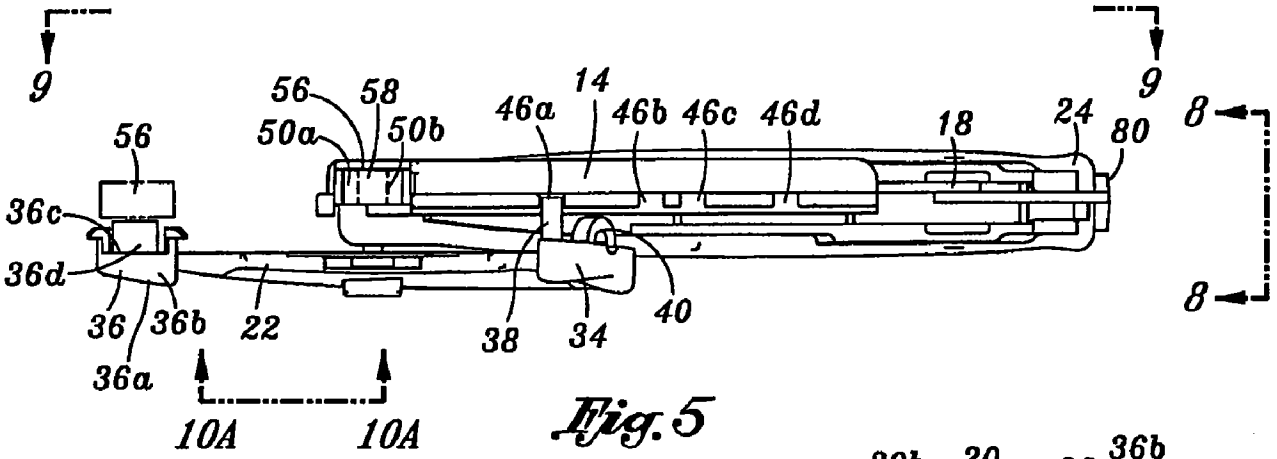
FIG. 5 is a plan view of the internal components of the knife with the housing removed taken along the line 5-5 in FIG. 2.

As depicted best in FIGS. 4A, 5 and 6, a finger element 38 that interacts with the slots 46*a*, 46*b*, 46*c*, and 46*d* serves as part of the locking mechanism 34 that holds the blade seat 14 in a selected position. The number of different positions the blade seat 14 can be locked into is determined by the number of slots on the top edge 14*d*. The slot 46*a* may lie in the front half 78 of the blade seat 14 while slots 46*b*, 46*c* and 46*d* may lie in the rear half of the blade seat. The slots 46*a*, 46*b*, 46*c*, 46*d* may be positioned such that when the blade seat 14 is extended, the blade 25 may protrude from the housing 12 in a multitude of different positions: One where a sixth of the blade 25 protrudes from the housing 12. Two, where a quarter of the blade 25 protrudes from the housing 12. Three, where a third of the blade 25 protrudes from the housing 12.

Figure 9:
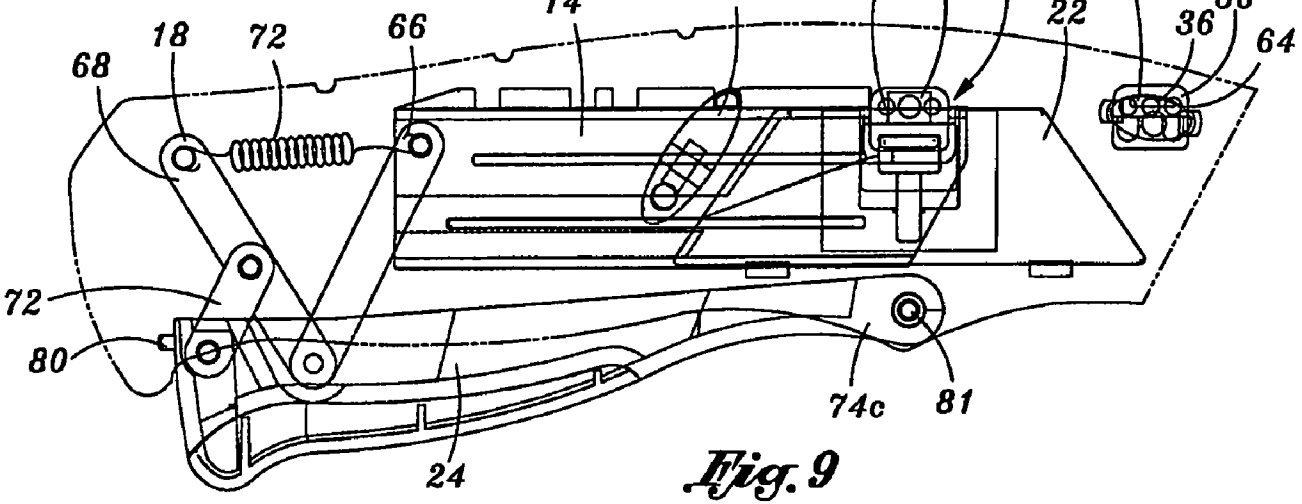
FIG. 9 is a side view taken along line 9-9 of FIG. 5, with the housing drawn in phantom lines.
Figure 8:
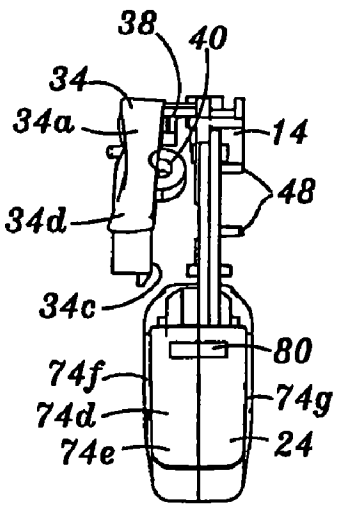
FIG. 8 is a rear view taken along line 8-8 of FIG. 5.

Referring to FIGS. 4 and 9, the blade retainer 56 may comprise a substantially rectangular block 60 having a blade side 60*a* including a platform 60*c*, and a back side 60*b*, and a pair of knuckles 62 beneath the platform that extend outward. A pair of holes 64 may extend through the platform 60*c* to the back side 60*b* of the block 60. The blade retainer 56 is coupled to the blade seat 14 by inserting the toes 50*a*, 50*b* through the pair of holes 64 to enable the blade retainer 56 to slide along the toes 50*a*, 50*b*. The thickness of the block 60 and the length of the toes 50*a*, 50*b* regulates the length of the path of travel of the block that moves between a blade engaging position and a blade disengaging position. The depth of the recessed portion 58 is set to allow the blade side 60*a* of the block 60 to lie just below the surface of the blade side 14*e* of the blade seat upon depressing the block 60, moving the block into the blade disengaging position. A spring (not shown) may be disposed on one or both of the toes 50*a*, 50*b* between the blade retainer 56 and the recessed portion 58 of the blade seat 14. The tensile strength and length of the spring (not shown) is typically chosen such that the spring will bias the blade retainer 56 to dispose the knuckles 62 between the notches 25*c* of the blade 25. This corresponds to the blade engaging position of the blade retainer 56.

Figure 10B:
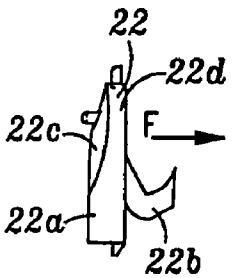
FIG. 10B is a side view taken along line 10B-10B of FIG. 10A.
Figure 10A:
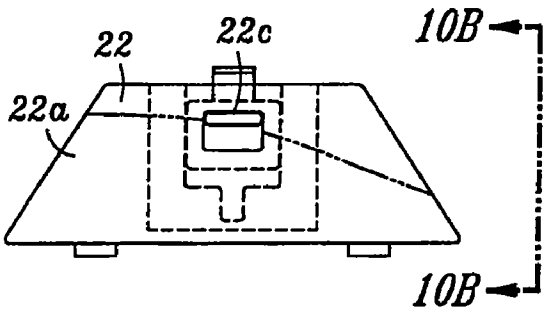
FIG. 10A is side view taken along line 10A-10A of FIG. 5 with a portion of a latch shown in phantom.

The blade storage station 20 may store a plurality of blades 25*a*, and typically comprises a hole 20*a* (FIG. 6) shaped to the outline of the blade 25 and the cover 22. The top 20*c*of the hole 20*a* may include a guide rail 20*b* that is typically shaped as a bisected cylinder. The guide rail 20*b* may be used to align a blade 25 or blades stored in the blade storage 20 by insertion of the guide rail into a notch 25*c* of a blade 25. The blade storage station 20 may be located near the front end 28*c* of the left portion 28. This blade storage 20 typically has depth between about 0.05 inch and about 0.25 inch allowing between one to about six blades to be stored therein. Referring to FIGS. 10A and 10B, the cover 22 member may be detachable from the housing 12 and may comprise a trapezoidal-shaped plate 22*a* having a spring mechanism 22*b* on its inner side 22*d* and a latch 22*c* that slides. The cover 22 covers the outer side of the blade storage station 20, while the spring mechanism 22*b* applies a lateral force F towards the blade seat 14 onto a stack (not shown) of blades contained within the blade storage 20.

As shown in FIGS. 4, 4A, 6 and 8, the locking mechanism 34 includes the finger element 38 and a button element 34*a*. The button element 34*a* may have an oval shape, a planar base 34*b* including an inner side 34*c*, an outer side 34*d*, and a ring 40 projecting from the inner side 34*c* of the base nearby the center of the base. The finger element 38 projects from an inner side 34*c* of the base 34*b*. The button element 34*a* may be disposed in an oval shaped hole 42 located in the left portion 28 of the housing 12, such that the button element projects at least partially through the housing. The lower half 34*e* of the base 34*b* may rise above the surface of the outer side 28*f* of the left portion 28, and the upper half 34*f* of the base may lie flush with the surface of the outer side 28*f* of the left portion 28. Alternately, the lower half 34*e* of the base 34*b* may be thicker than the upper half 34*f*, such that the lower half 34*e* is raised above surface of the outer side 28*f* of the housing 12. The hole 42 may be located near the center of the left portion 28 of the housing 12, adjacent to the blade storage station 20 such that when a user holds in his or her right hand the handle 12*e*, the button element 34*a* may be depressed by with his or her right thumb.

As best illustrated in FIGS. 4A, 5 and 6, seated within the hole 42 is a lower, inner wall 42*a* of the button element 34*a*. On the inner side 28*e* of the left portion 28 of the housing 12 straddling the hole 42 is a pair of perforated walls 51 and 53 that provide a space for the ring 40. There is a pivot pin 42*b* that extends across the hole 42 through the pair of perforated walls 51 and 53 and the ring 40 to rotatably couple the button element 34*a* to the housing 12. As depicted in FIG. 4A, a coiled spring element 44 may be disposed in an indentation 43 in a side wall surrounding the hole 42. An end of the spring element 44 bears against the inner wall 42*a* of the button element 34*a*, rotatably biasing the button element so the finger element 38 normally engages one of the slots 46*a*, 46*b*, 46*c*, and 46*d* in the blade seat 14 when aligned with one of these slots. The outer side 28*f* of the left portion 28 of the housing 12 may have a groove 28*g* that extends from the rear end 28*d* of the left portion 28 to the button element 34*a* such that a user's thumb may be guided by the groove to the button element when a user holds the knife 10.

Referring to FIGS. 1, 3, 4, 6 and 9, the blade release mechanism 36 enables a user to remove a blade 25 that partially projects outward from the housing 12. This blade release mechanism 36 comprises a button element 36*a* disposed within a hole 64 in the housing 12. The button element 36*a* comprises a base 36*b* having an interior side 36*c* and a finger element 36*d* (FIG. 6) extending from the interior side of the base. The hole 64 may be located between the front end 28*c* of the left portion 28 and the blade storage station 20. The blade release mechanism 36 unloosens the blade 25 from the blade seat 14 when a user manually depresses the button element 36*a* towards the blade retainer 56 pushing this blade retainer inward, allowing the blade 25 to be manually pulled from the housing 12. Upon depressing the button element 36*a*, the finger element 36*d* moves the blade retainer 56 deeper into the recessed portion 58 of the blade seat 14 so that the knuckles 62 on the blade retainer no longer lie in the notches 25*c* on the blade 25, allowing the blade to be moved manually relative to the blade seat 14. To allow the manual removal of the blade 25, the blade seat 14 is in an extended position so that a user can grasp the blade and remove it. The blade seat 14 may be moved into a fully extended position such that the blade retainer 56 and the blade release mechanism 38 are aligned to facilitate movement of the blade retainer between the blade engaging position and the blade disengaging position. The blade retainer 56 is typically aligned with the blade release mechanism 36 when the blade seat is in a fully extended position.

Referring to FIGS. 4 and 9, a blade 25 mounted to the blade seat 14 may be replaced by another blade 25*a* stored in the blade storage station 20. This may be accomplished by first extending the blade seat 14 to align the blade retainer 56 with the blade release mechanism 36. A user then presses the blade release mechanism 36 to slide the blade retainer 56 inward so the knuckles 62 are no longer disposed within the notches 25*c* of a blade 25 on the blade seat 14. Next, the user grasps the portion of the blade extending from the housing 12 and manually pulls the blade 25 from the housing. The blade seat 14 may then be retracted, and while retracted, the spring mechanism 22*b* loads another blade 25*a* from a stack of blades in the blade storage station 20 onto the blade seat.

Figure 2:
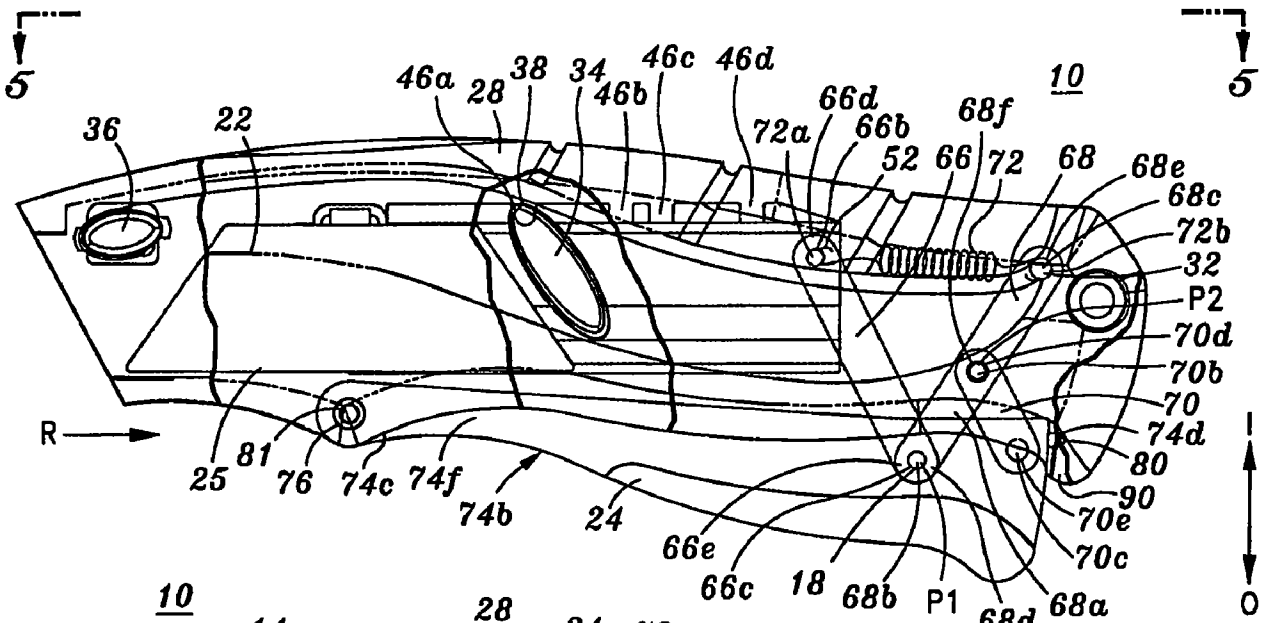
FIG. 2 is a side view of the knife shown in FIG. 1 with sections broken away and some components shown in phantom lines.

Referring to FIGS. 2, 3, 4 and 9, the linkage assemblage 18 may comprise an arm 66, an arm 68, an arm 70, and an elastic return mechanism, namely, a coiled metal spring 72. As best shown in FIGS. 2 and 3, the arm 66, arm 68 and arm 70 are connected together so that they may be moved between a folded condition as shown in FIG. 2 and an unfolded condition as shown in FIG. 3. Each may comprise a flat, elongated, rectangular bar 66*a*, 68*a*, 70*a*, with a pair of rounded ends 66*d* and 66*e*, 68*d* and 68*e*, and 70*d* and 70*e*, respectively, and at opposed ends, a pair of open-ended holes 66*b* and 66*c*, 68*b* and 68*c*, and 70*b* and 70*c*, respectively. Each hole 66*b* and 66*c*, 68*b* and 68*c*, and 70*b* and 70*c* is nearby a rounded end 66*d* and 66*e*, 68*d* and 68*e*, and 70*d* and 70*e* as the case may be. The arm 66 and the arm 68 may be of substantially equal length while arm 70 may be shorter than the arms 66 and 68. The spring 72 extends between the anchors 32 and 52, having its one end 72*a* attached to the anchor 52 and its other end 72*b* attached to the anchor 32. The one end 66*d* of the arm 66 may be coupled to the blade seat 14 by inserting the anchor 52 through hole 66*b* and the other end 66*e* of the arm 66 may be coupled to the arm 68 by passing a pin P1 through holes 66*c* and 68*b*. The arm 68 in addition to being coupled to the arm 66 may also be coupled to the housing 12 by passing the anchor 32 through hole 68*c*. In an intermediate section of the arm 68, there is a hole 68*f* about midway between the ends 68*d* and 68*e*. The arm 70 may be coupled to this intermediate section of this arm 68 by a pin P2 that extends through the hole 70*b* in the arm 70 and into the hole 68*f* in the arm 68 to couple the end 70*d* to the arm 68. The other end 70*e* of the arm 70 is coupled to the trigger actuator 24 by a pin P3. The pins P1, P2, and P3 serve as pivot points for the arms 66, 68, and 70.

By squeezing the trigger actuator 24 it is manually moved between a ready, retracted position with the blade 25 withdrawn as shown in FIG. 2 and a cutting position with the blade 25 extended as shown in FIG. 3. Referring to FIGS., 1, 7, 8 and 9, the trigger actuator 24 may comprise a generally triangular body 74 extending lengthwise along the underside 12*b* of the housing 12, nearby the handle 12*e*. The body 74 may have a hollow interior I with an open top side 74*a*, a curved bottom side 74*b*, a left side 74*f*, a right side 74*g*, a curved pivoted end 74*c*, and a rectangular wall 74*d* at its rotating end 74*e*. The bottom side 74*b* may comprise a grip portion 74*h* made from a substantially non-slippery material such as rubber and the bottom side 74*b* may be curved generally to shape of a closed human hand. The body 74 has a hole 76 at the end 74*c* and a stop member 80 at the end 74*e*. The hole 76 is located nearby the pivoted end 74*c* and extends laterally from the left side 74*f* to the right side 74*g*. The trigger actuator 24 may be pivotally connected at the pivoted end 74*c* to the housing 12 by a rod 81 extending through the hole 76. When the trigger actuator 24 moves between the ready position as shown in FIG. 2 and the cutting position as shown in FIG. 3, the trigger actuator 24 rotates about the rod 81. The rotating end 74*e* may have a stop member 80 that may comprise a wall projecting from the outer side of the rectangular wall nearby the top side 74*a*. The stop member 80 is disposed within the housing 12, and, as shown in FIG. 2, restricts the rotation of the trigger actuator 24 in the clockwise direction by contacting the inner ledge 90 of the housing 12.

The locking mechanism 34 including the finger element 38 is used to lock the blade seat 14 in a selected position. Inserting the finger element 38 into one of the slots 46*a*, 46*b*, 46*c*, and 46*d* locks the blade in position. Removing the finger element 38 from a slot, unlocks the blade seat 14. As shown in FIGS. 2 and 5, when the finger element 38 is inserted into the slot 46*a*, the blade seat 14 is locked in the retracted position. Manually depressing the button element 34*a* withdraws the finger element 38 from this slot 46*a*. Squeezing the trigger actuator 24 unfolds and extends the linkage assemblage 18 to advance the blade seat 14. Upon release of the button element 34*a*, the finger element 38 will be inserted into one of the slots 46*b*, 46*c*, or 46*d*, depending on which slot is aligned with the finger 38 upon the user releasing his or her grip on the trigger actuator 24.

In use the knife 10 may be held such that the front portion 12*c* of the housing 12 is also the distal end, and the rear portion 12*d* of the housing 10 is the proximal end. It is also contemplated that the knife 10 may be held such that the rear portion 12*d* of the housing 12 may be the distal end and the front end of the housing the proximal end. As illustrated in FIG. 2, when the blade seat 14 is in a retracted position, the trigger actuator 24 is in a ready position, the linkage assemblage 18 is in a folded condition, the blade 25 is wholly contained within the housing 12, and the spring 72 is in an unstretched condition. The arm 66 and arm 68 may form an angle less ninety degrees. As illustrated in FIG. 3, when the blade seat 14 is in an extended position, the linkage assemblage 18 is in an unfolded condition, the trigger actuator 24 is at least partially moved into the housing 12, a portion of the blade 25 lies external to the housing, and the spring 72 is stretched and in tension. The arm 66 and arm 68 may form an angle greater than ninety degrees.

A user may extend the blade 25 so that it protrudes from the housing 12 by first actuating the locking mechanism 34 to unlock the blade seat 14 by depressing and rotating the button element 34*a*. A user then squeezes the trigger actuator 24 causing the trigger actuator to rotate and move into the housing 12 and unfold the linkage assemblage 18. The unfolding linkage assemblage 18 causes the blade seat 14 to advance and the blade 25 to protrude from the housing 12. The spring element 44 rotates the button element 34*a* of the locking mechanism 34 in a direction towards the blade seat 14 to lock the blade seat in the extended position when the finger element 38 is aligned with one of the slots 46*b*, 46*c*, or 46*d*. A user may then utilize the blade 25. To retract the blade 25, the user depresses the button element 34*a* of the locking mechanism 34 using his or her thumb, which is guided to the button element by the groove 28*g*. Manually depressing the button element 34*a* rotates the button element away from the blade seat 14 to withdraw the finger element 38 from the slot in which it is lodged. This unlocks the blade seat 14 and the stretched spring 72 pulls the blade seat 14 into the retracted position shown in FIG. 2.

Figure 11:
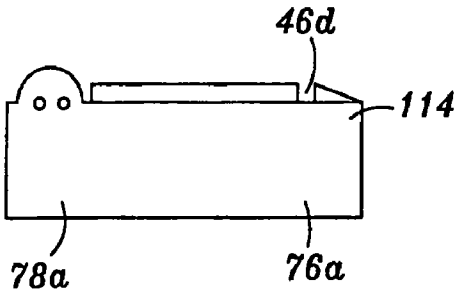
FIG. 11 is side view of a blade seat with a slot located in the rear half of the blade seat.

FIG. 11 illustrates another embodiment of this invention that is essentially the same as that of the embodiment shown in FIGS. 1 through 10B, except a different blade seat 114 is employed. In this embodiment shown in FIG. 11, the locking mechanism 34 keeps the blade seat 114 in the extended position until unlocked. This is achieved by employing only a single slot 46*d* in the blade seat 114 located in the rear half 76*a* of the blade seat. The blade seat 114 does not have any slots located in the blade seat's front half 78*a*. Initially the blade seat 114 is positioned within the housing 12 similar to that of the blade seat 14 shown in FIG. 2, but the blade seat 114 is not locked in this retracted position. Upon squeezing the trigger actuator 24, the blade seat 114 advances to a fully extended position with the finger element 38 aligned with the slot 46*d*. The button element 34*a* being biased to move towards the blade seat 114 causes the finger element 38 to extend into the slot 46*d*, locking the blade seat 114 in the extended position. Pressing the button element 34*a* will causes the button element 34*a* to rotate away from the blade seat 114 and pull the finger element 38 from the slot 46*d*. With the release of the user's grip on the trigger actuator 24, the extended spring element 72 in tension pulls the blade seat 114 into the housing 12, returning it to the retracted position like the seat 14 shown in FIG. 2.

Figure 12:
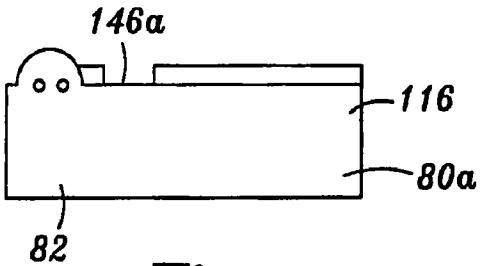
FIG. 12 is side view of a blade seat with a slot located in the front half of the blade seat.

Referring to FIG. 12, in another embodiment, the locking mechanism 34 locks a blade seat 116 in the retracted position. The blade seat 116 has only a single slot 146*a* located in the front half 82 of the blade seat 116 but no slots located in its rear half 80*a*. Consequently, the blade seat 116 cannot be locked in an extended position. The button element 34*a*, however, must be manually depressed to allow the blade seat 116 to be moved into the extended position. Consequently, the user must maintain his or her grip on the trigger actuator 24, squeezing it to hold the blade seat 116 in the extended position. Upon the user releasing his or her grip on the trigger actuator 24, the extended spring element 72 returns the blade seat 116 to the retracted position and the coiled spring element 44 rotates the button element 34*a* towards the blade seat 116 and the finger element 38 is pushed into the aligned slot 146*a*.

Figure 13B:
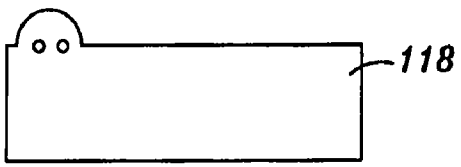
FIG. 13B is a side view of a blade seat that does not have any slots.
Figures 13A, 14:
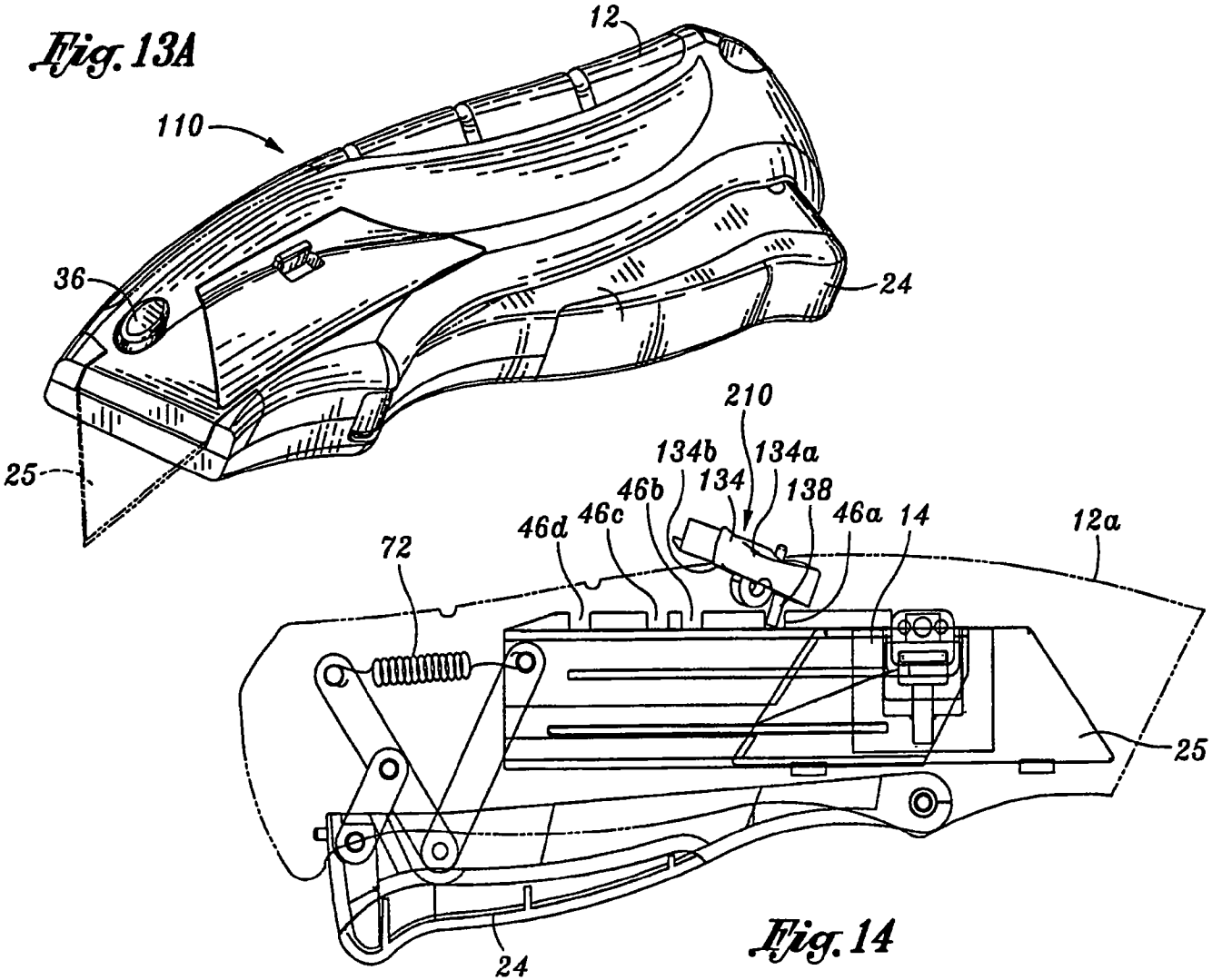
FIG. 13A is a perspective view of one embodiment of a knife that does not have a locking mechanism.
FIG. 14 is a side view of a knife with the housing drawn in phantom lines, and a locking mechanism coupled to the top wall of the housing.

FIGS. 13A and 13B illustrate yet another embodiment which is similar to the embodiment shown in FIGS. 1 through 10B, but where no locking mechanism 34 is used. In this embodiment, a blade seat 118 without any slots is employed. Consequently, a user is not required to unlock the blade seat 118 before squeezing the trigger actuator 24. A user manually squeezes the trigger actuator 24 to extend the blade seat 118 from the retracted position and releases his or her grip on the trigger actuator 24 to allow the extended spring element 72 to retract the blade seat 118 into the housing 12. The user maintains his or her grip on the trigger actuator 24 to keep the blade seat 118 in the extended position.

FIG. 14 illustrates an embodiment of a knife 210 where a locking mechanism 134 including a spring biased button 134*a* similar to the button element 34*a* is located on the top wall 12*a* of the housing 12. The button 134*a* has a finger element 138 projecting from its backside 134*b*. Like the finger element 38 of the button element 34*a*, the finger element 138 locks the blade seat 14 in a selected position by being disposed within one of the slots 46*a*, 46*b*, 46*c* and 46*d*.

Figures 15A, 15B:
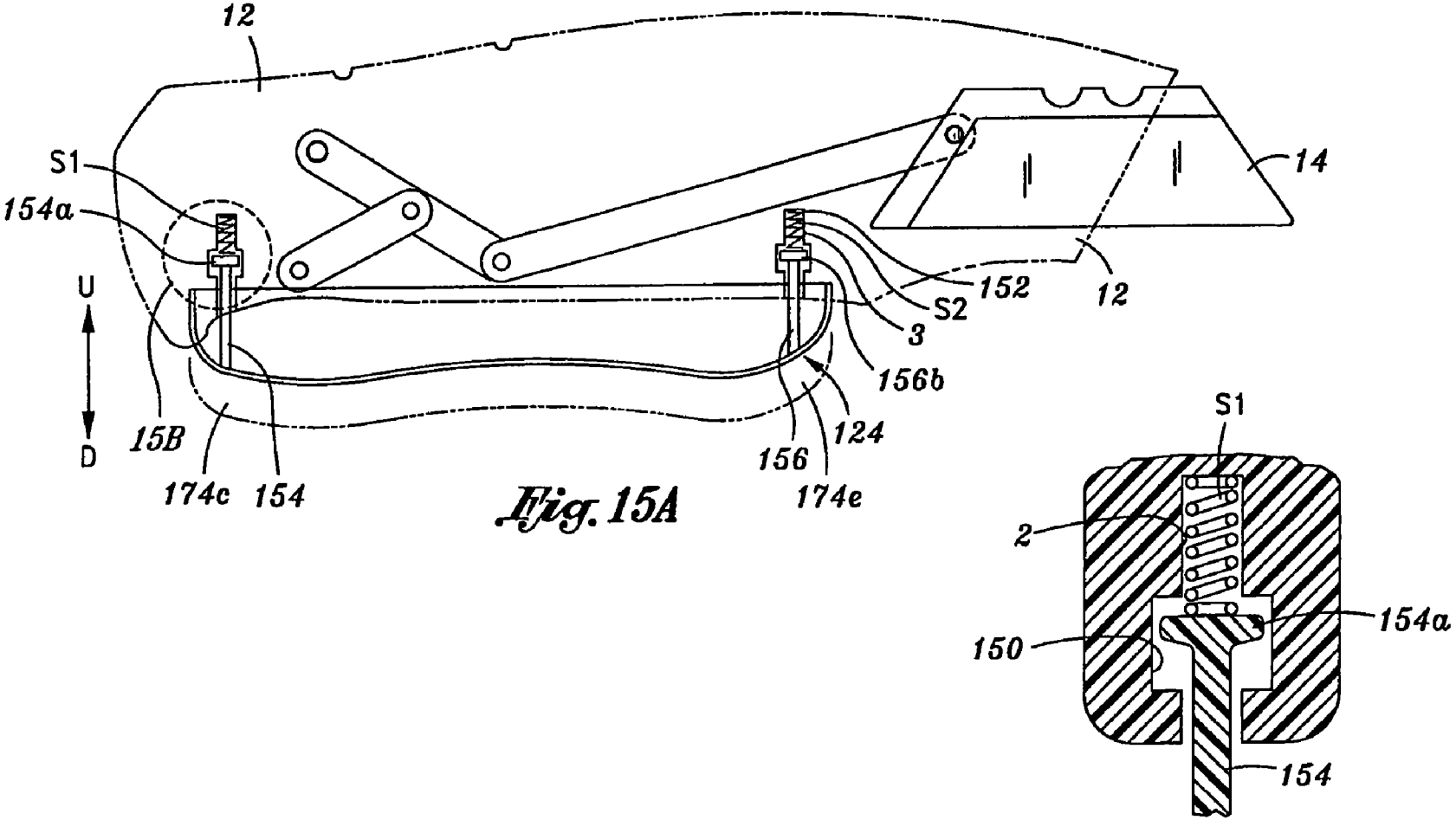
FIG. 15A is a side view of a knife with the housing drawn in phantom lines, and a trigger actuator coupled to the housing to slide.
FIG. 15B is an enlarged fragmentary cross-sectional view taken along line 15B of FIG. 15A.

FIGS. 15A and 15B illustrate an embodiment where a trigger actuator 124 slides in and out relative to the housing 12 rather than pivoting to move the blade seat 14 between retracted and extended positions. This embodiment has posts 154 and 156 with flat heads 154*a* and 156*a*, respectively. The ends of the posts 154 and 156 opposite the flat heads 154*a* and 156*a* are fixedly attached to the trigger actuator 124. The heads 154*a* and 156*a* of the posts 154 and 156 are respectively seated in slots S1 and S2 in the underside of the housing 12, with each slot having an enlarged cavity 150 and 152 respectively that receives therein the flat heads 154*a* and 156*a*. There are lodged within the slots S1 and S2 respectively a coiled spring 2 and a coiled 3. These springs 2 and 3 normally bias the trigger actuator 124 outward from the housing 12 as shown in dotted lines, pulling the blade seat 14 into a retracted position. Squeezing the trigger actuator 124 to move it to the position shown in solid lines moves the blade seat 14 to the extended position. Upon release of the trigger actuator 124, the springs 2 and 3 return the trigger actuator 124 to the position shown in dotted lines, pulling the blade seat 14 into the retracted position. As the heads 154*a* and 156*a* slide within the cavities 150 and 152 with the actuation of the trigger actuator 124, the opposed walls of these cavities act as stops to limit the movement of the trigger actuator 124. Both the end 174*c* and end 174*e* of the trigger actuator 124 move up U and down D. The end 174*e* may have the stop member 80 projecting from the outer side of the rectangular wall nearby the top side 74*a*. The stop member 80 is disposed within the housing 12, and may restrict the movement of the trigger actuator 124 when coming into contact with ledge 90.

Figure 15C:
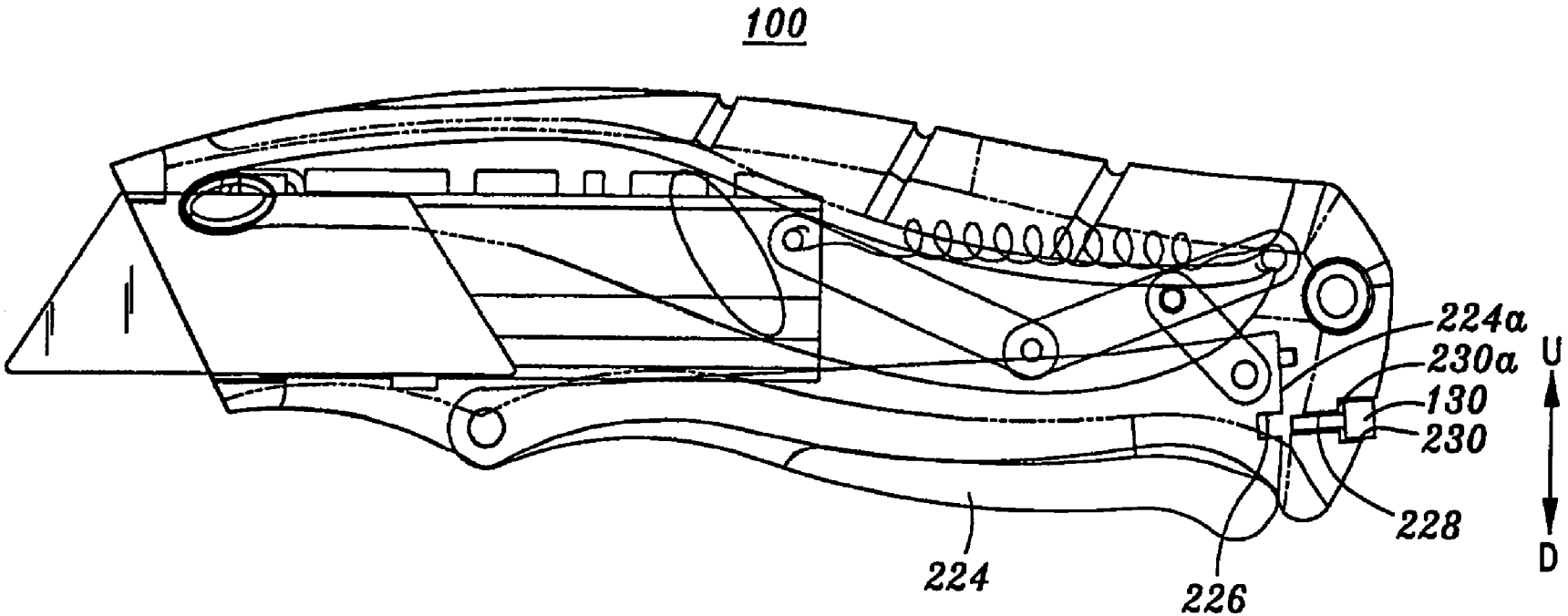
FIG. 15C is a side view of a knife with the housing drawn in phantom lines, and a trigger actuator having a locking button.

FIG. 15C illustrates an embodiment of a knife 100 where a button 130 may be used to lock a trigger actuator 224 when the trigger actuator is in a retracted position. The trigger actuator 224 is substantially identical to that shown in FIG. 1. The button 130 may have a cylindrical main body 230 with a finger element 228 extending from the inner end 230*a* therefrom. The finger element 228 locks the trigger actuator 224 when disposed within a cavity 226 located at the rear end 224*a* of the trigger actuator.

Figure 16A:
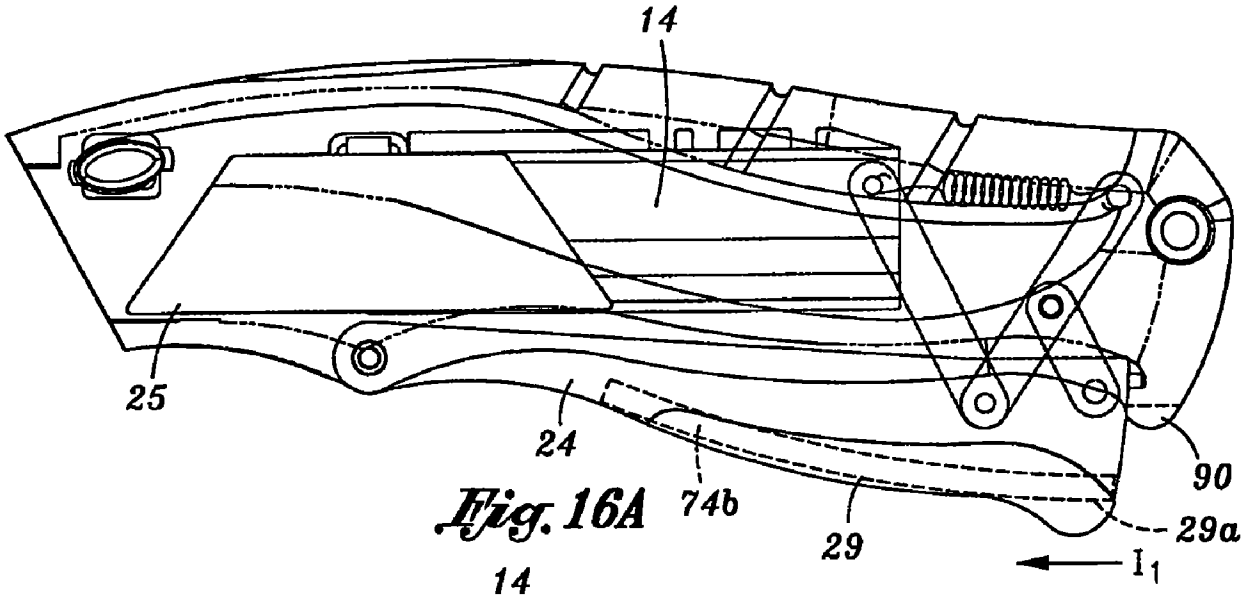
FIG. 16A is a side view of a knife having a locking bar associated with the trigger actuator in a retracted position.
Figure 16B:
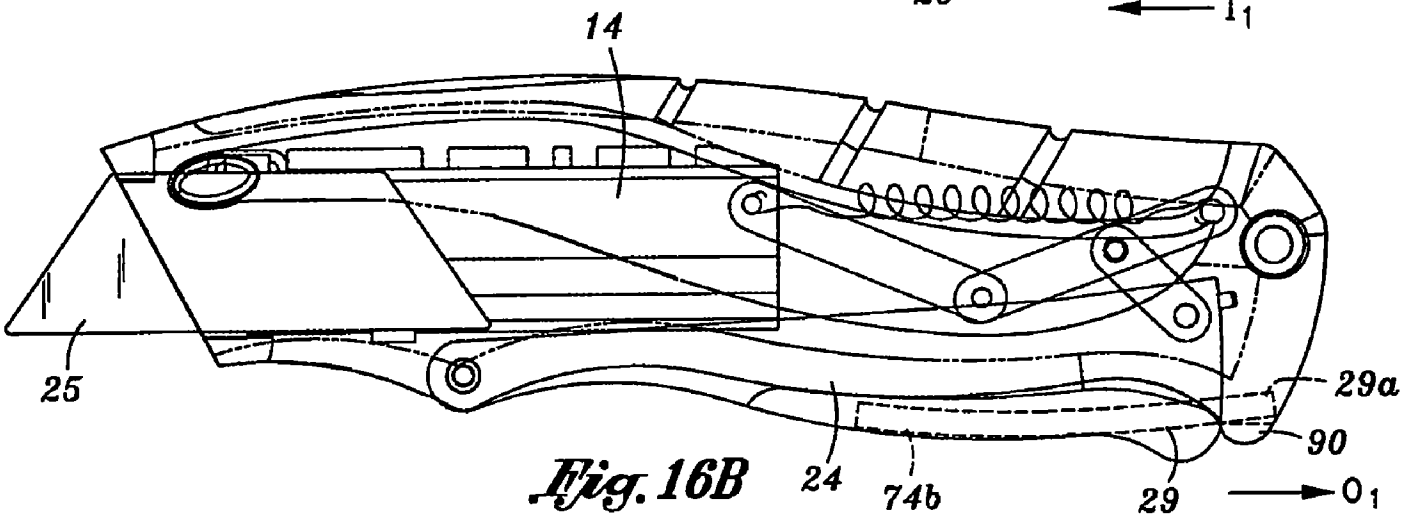
FIG. 16B is a side view of the knife of FIG. 16A showing the locking bar in an extended position.

FIGS. 16A and 16B illustrate an embodiment of the knife 10 where the locking mechanism is a locking bar 29 that is mounted internally in the trigger actuator 24. This locking bar 29 slides along the bottom side 74*b* of the trigger actuator 24. FIG. 16A illustrates where the locking bar 29 is slid inward $I_1$ and the trigger actuator 24 is in an extended position with the blade 25 withdrawn into the housing 12. FIG. 16B illustrates the trigger actuator 24 manually squeezed and the locking bar 29 is slid outward $O_1$ so its outer end 29*a* engages the ledge 90. A user may slide the locking bar 29 inward $I_1$ and outward $O_1$ by using one of his or her finger or thumb. Initially the locking bar 29 is in the position shown in FIG. 16A and the blade seat 14 is in the retracted position, but not locked in this position. Upon squeezing the trigger actuator 24, and then sliding the locking bar 29 outward $O_1$, the blade seat 14 is locked in the extended position. With the release of the user's grip on the trigger actuator 24 and sliding the locking bar 29 inward $I_1$, the extended spring element 72 returns the blade seat 14 to the retracted position shown in FIG. 16A.

Figure 17:
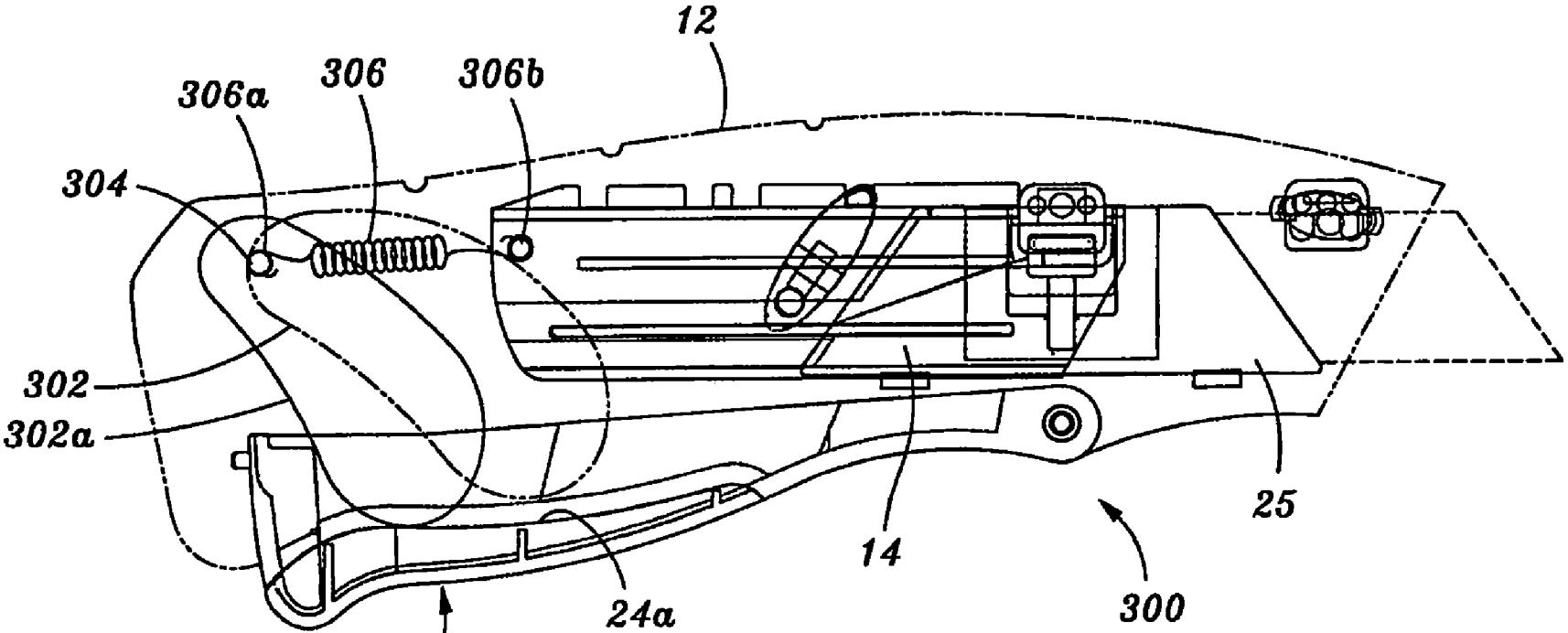
FIG. 17 is a side view of a knife where a cam engaging an internal surface of a trigger actuator is used to move the blade retainer between retracted and extended positions.

As shown in FIG. 17, a knife 300 is substantially the same as the knife 10, but the linkage assembly 18 is eliminated. In place of the linkage assembly 18 is a cam 302 mounted by a pivot pin 304 within the housing 12 of the knife 300. A spring 306 has one end 306*a* fixedly attached to the pivot pin 304 and another end 306*b* fixedly attached to the rear end of the blade retainer 14. The lower edge 302*a* of the cam 302 rests against an internal surface 24*a* of the trigger actuator 24. When the trigger actuator 24 is manually squeezed, the lower edge 302*a* of the cam 302 rides over this internal surface 24*a* and rotates counterclockwise as viewed in FIG. 17 with its side edge engaging and pushing the blade retainer 14 from its retracted position shown in solid lines to its extended position shown in dotted lines. When the user releases his or her grip on the trigger actuator 24, the spring 306 moves the blade retainer from the extended position into the retracted position.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention.

We claim:

1. A knife comprising an elongated housing having a forward end adapted to enable a blade to extend therethrough and a rear end including a handle portion, a blade seat at least partially retained in said housing and movable between a retracted position and an extended position, said blade seat being adapted to hold at least one detachable blade, a trigger actuator attached to said blade seat and mounted to said housing nearby said handle portion, said trigger actuator movable from a first position where the blade seat is in said retracted position to a second position where said blade seat is in said extended position, a linkage assemblage at least partially within the housing and connected between the trigger actuator and the blade seat that moves the blade seat into the extended and retracted positions, said linkage assemblage including a return mechanism that normally returns the blade seat to the retracted position, the linkage assemblage including first, second, and third arms, each arm having first and second opposite ends, wherein:

the first end of the first arm is rotatably pinned to the trigger actuator, the second end of the first arm is rotatably pinned to the second arm;

the second arm is rotatably pinned to the housing;

the first end of the third arm is rotatably pinned to the blade seat; and the second end of the third arm is rotatably pinned to the second arm.

2. The knife of claim 1, further including:

a locking and unlocking mechanism including a manually actuated element on an exterior portion of the housing, said manually actuated element spring biased so a portion thereof normally engages the blade seat to hold said blade seat in a selected position and, upon being actuated, disengages so that said return mechanism returns the blade seat to the retracted position.

3. The knife of claim 2 wherein the manually actuated element includes:

a button element projecting through the side wall to enable a thumb of a user's hand while gripping the handle portion and the trigger actuator to depress the button element, said button element having an interior side from which a finger element projects to engage the blade seat when the button element is not depressed and disengage when the button element is depressed.

4. The knife of claim 3 including a guide groove in the exterior side of the housing extending rearward of the button element and having a terminal end adjacent the button element.

5. A knife comprising an elongated housing having a topside, an underside, and opposed side walls connecting the topside and the underside, a forward end adapted to enable a blade to extend therethrough and a rear end including a handle portion, a blade seat retained in said housing and movable between a retracted position and an extended position, said blade seat being adapted to hold at least one detachable blade, said blade seat in the extended position having at least a portion of a blade mounted thereon extending through the forward end, a trigger actuator attached to said blade seat and mounted to pivot at one end to said housing nearby said handle portion and along the underside of the housing, said trigger actuator movable from a first position where the blade seat is in said retracted position to a second position where said blade seat is in said extended position, and a locking and unlocking mechanism including a manually actuated locking element included in the trigger actuator and movable from a retracted, unlocked position within the trigger actuator to an extended, locked position with a portion of the locking element engaging the rear end of the housing.

* * * * *